US005801605A

United States Patent [19]

Filakovsky

[11] Patent Number: 5,801,605

[45] Date of Patent: Sep. 1, 1998

[54] DISTRIBUTED TEM FILTER WITH INTERDIGITAL ARRAY OF RESONATORS

[75] Inventor: John Gene Filakovsky, Trumbull, Conn.

[73] Assignee: Microphase Corporation, Norwalk, Conn.

[21] Appl. No.: 701,774

[22] Filed: Aug. 26, 1996

[51] Int. Cl.[6] ..... H01P 1/201; H01P 1/203; H01P 1/205

[52] U.S. Cl. ..... 333/203; 333/204; 333/206; 333/208

[58] Field of Search ..... 333/203, 204, 333/202, 208

[56] References Cited

U.S. PATENT DOCUMENTS

| | | | |
|---|---|---|---|
| 3,327,255 | 6/1967 | Bolljahn et al. | 333/203 |
| 4,034,319 | 7/1977 | Olsson | 333/203 |
| 4,179,673 | 12/1979 | Nishikawa et al. | 333/204 |
| 4,216,448 | 8/1980 | Kasuga et al. | 333/203 |
| 5,160,905 | 11/1992 | Hoang | 333/203 X |

FOREIGN PATENT DOCUMENTS

| | | | |
|---|---|---|---|
| 0170101 | 10/1983 | Japan | 333/203 |
| 0178601 | 10/1983 | Japan | 333/203 |

OTHER PUBLICATIONS

G. Matthaei, "Comb-Line Band-Pass Filters of Narrow or Moderate Bandwidth", Microwave Journal, pp. 82–83, Aug., 1963.

R. Kurzrok, "Design of Comb-Line Band-Bass Filters", IEEE Transactions on Microwave Theory and Techniques, pp. 351–353, Jul., 1996.

G. Matthaei, "Interdigital Band-Pass Filters", IRE Transactions on Microwave Theories and Techniques, pp. 479–480, Nov., 1962.

R. Kurzrok, "Design of Interstage Coupling Apertures for Narrow-Band Tunable Coaxial Band-Pass Filters", IRE Transactions on Microwave Theories and Techniques, pp. 143–144, Mar., 1962.

H. Yao, Full Wave Modeling of Conducting Posts in Rectangular Waveguides and Its Applications to Slot Coupled Combline Filters, IEEE Transactions on Microwave Theory and Techniques, p. 2824, Dec., 1995.

*Primary Examiner*—Robert J. Pascal
*Assistant Examiner*—Barbara Summons
*Attorney, Agent, or Firm*—Perman & Green, LLP

[57] ABSTRACT

A distributed TEM resonator band pass filter has a set of rod-shaped resonators arranged in an interdigital line with alternate ones of the resonators being grounded to opposite walls of a housing. Each resonator has an ungrounded end which is capacitively coupled to a wall of the housing. Partitions, grounded to the housing, are located between successive ones of the resonators. Each partition closes off only a portion of the space between neighboring resonators to leave a coupling aperture. The interdigital arrangement provides for reduced loss and a higher Q. Input and output ports are provided at opposite ends of the interdigital line. The resonators may be constructed in the form of a suspended substrate, a stripline, or a microstrip configuration.

11 Claims, 2 Drawing Sheets

DISTRIBUTED TEM FILTER WITH INTERDIGITAL ARRAY OF RESONATORS

BACKGROUND OF THE INVENTION

This invention relates to distributed TEM (transverse electromagnetic) band pass filters and, more particularly, to such a filter constructed with an interdigital array of resonators having partitions disposed between successive ones of the resonators, the entire filter assembly being enclosed within a housing to which the partitions and one end of each of the resonators are grounded.

Typical narrow-band (less than 5–10% passband width) distributed TEM resonator bandpass filters have been constructed of a combline array of resonators grounded to a housing on a common side of the housing. Narrow bandwidths are achieved by using conducting surfaces to reduce the coupling between adjacent resonators thereby reducing the bandwidth. The conducting surfaces, which are grounded to the housing, may be of the form of walls, partitions, posts, or rods, by way of example. A bandpass filter of this type is referred to typically, as a cavity filter. The resonators in a combline type of filter must be foreshortened from a quarter wavelength of the radiation within the housing to avoid a no-pass response of the filter due to a complete cancellation of equal magnetic and electric fields which are in phase opposition, such phase opposition resulting for quarter wavelength lines. Such construction is disclosed in an article by George L. Matthaei, the MICROWAVE JOURNAL, pp. 82–91, August, 1963; and in a paper by R. M. Kurzrok in the IEEE TRANSACTIONS ON MICROWAVE THEORY AND TECHNIQUES, pp. 351–353, July 1966; and in further articles by George L. Matthaei, IRE TRANSACTIONS ON MICROWAVE THEORIES AND TECHNIQUES, pp. 479–491, November 1962; by Richard M. Kurzrok, IRE TRANSACTIONS ON MICROWAVE THEORIES AND TECHNIQUES, pp. 143–144, March 1962; and by Hui-Wen Yao in the IEEE TRANSACTIONS ON MICROWAVE THEORY AND TECHNIQUES, pp. 2824–2830, December, 1995. The foreshortening is operative to allow a net magnetic coupling to achieve a bandpass response, but the foreshortening also increases the passband loss of the filter by reducing the Q or qualitative quality factor of the TEM resonator.

An interdigital arrangement of resonators may be employed instead of of the combline arrangement of resonators. Such an interdigital band pass filter avoids the increased insertion loss of foreshortened resonators by grounding every other resonator on one side. The resulting filter structure achieves the strongest net coupling with no resonator foreshortening thereby resulting in the lowest loss but with a relatively wide bandwidth for any reasonable resonator spacing.

Thus, there is a problem in that the combline arrangement of resonators in a distributed TEM bandpass filter provides for increased passband loss while, in the alternative configuration of an interdigital arrangement of resonators, the filter bandwidth may be larger than desired.

SUMMARY OF THE INVENTION

The aforementioned problem is overcome and other advantages are provided by a distributed TEM resonator bandpass filter which, in accordance with the invention, provides for both low-loss and narrow band, while having a compact configuration. The filter achieves a compact, narrow band, low-loss bandpass response by using interdigitated quarter-wave length resonators in a cavity type configuration with walls, partitions, rods, posts, or other means for reducing the relatively strong interdigital coupling to that required for a desired narrow filter bandwidth. This form of construction is also suitable for multiplexers where more than one pass band response is desired. In particular, it offers desirable performance advantages in filter duplexers used in communication systems. The configuration of the invention is also suitable for TEM or quasi-TEM distributed resonator bandpass filters that use some type of dielectric material in conjunction with a conducting resonator, such as a microstrip, suspended substrate, or stripline type filter implementation, as will be described in alternative embodiments of the invention.

The microwave structure of the invention, whether the structure be a filter, or a multiplexer, or a diplexer, comprises an electrically conductive housing which, in a preferred embodiment of the invention has two opposed broad walls joined by two opposed sidewalls. In the interdigital arrangement of the resonators enclosed within the housing, one set of resonators is grounded to a first of the sidewalls, and a second set of the resonators is grounded to the second sidewall of the housing. The remaining ends of the respective resonators are spaced apart from a sidewall to provide for capacitive coupling to the sidewall. Thus, the resonators are arranged serially along a longitudinal dimension of the housing with alternate ones of the resonators being grounded by the first sidewall while the remaining resonators are grounded to the second sidewall. In addition, a set of partitions is located within the housing and is grounded to the first and the second sidewalls. The partitions are positioned between successive ones of the resonators of the interdigital array of resonators. The partitions may be configured as a portion of a wall or simply a rod or post, thereby providing an aperture or open space for coupling electromagnetic radiation between successive ones of the resonators.

In this configuration of microwave structure there is reduced intensity of surface current developed at each of various locations within the microwave structure, this resulting in a lower amount of energy loss per cycle of the electromagnetic radiation within the microwave structure. The amount of the coupling between the resonators is adjusted to provide for a desired bandwidth, in the case of a microwave structure serving as a filter, while maintaining a high Q (quality factor) due to the reduced losses associated with excessively high surface currents.

BRIEF DESCRIPTION OF THE DRAWING

The aforementioned aspects and other features of the invention are explained in the following description, taken in connection with the accompanying drawing figures wherein.

Figure 1:
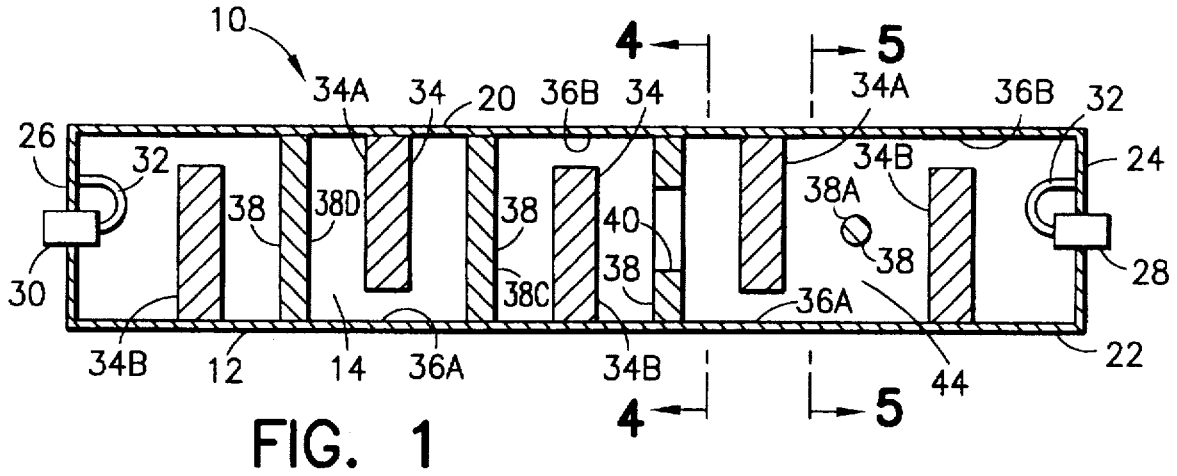
FIG. 1 is a longitudinal sectional view taken through opposed sidewalls of a housing showing an arrangement of an interdigital array of resonators spaced apart and separated by partitions in accordance with the invention.

Identically labeled elements appearing in different ones of the figures refer to the same element but may not be referenced in the description for all figures.

DETAILED DESCRIPTION

FIGS. 1–2 and 4–5 show details in the construction of a microwave structure embodying the invention. The construction of the microwave structure is suitable for resonator band pass filters, multiplexers wherein more than one passband response is desired, and in filter duplexers used in communication systems. To simplify the description of the invention, the microwave structure will be described in terms of a filter 10, it being understood that the teachings apply also to the multiplexers and duplexers.

The filter 10 is a distributed TEM resonator bandpass cavity filter. The filter 10 comprises a housing 12 which encloses a cavity 14, the housing 12 being composed of a broad wall 16 and a broad wall 18 which are spaced apart from each other and joined by sidewalls 20 and 22. The housing 12 is closed off on both ends by end walls 24 and 26. The housing 12 is constructed of electrically conductive material, such as copper, and the broad walls 16 and 18 make electrical contact with the sidewalls 20 and 22 and the end walls 24 and 26. Either end of the housing 12 may be regarded as the input, with the other end serving as the output and, by way of example, there is an input port 28 located in the end wall 24 and an output port 30 located in the end wall 26. Each of the ports comprises, by way of example, a coaxial line wherein the outer conductor contacts the end wall, and the inner conductor forms a loop 32 which connects with the respective end wall.

In accordance with the invention, the filter 10 further comprises an interdigital arrangement of resonators 34, each of which has the shape of a rod. The resonators 34 are further identified as a first set of resonators 34A and a second set of resonators 34B. Each of the resonators 34A is grounded to the sidewall 20 and is capacitively coupled via a gap 36A to the sidewall 22. Each of the resonators 34B of the second set of resonators is grounded at one end to the second sidewall 22 and is capacitively coupled at the opposite end by a gap 36B to the sidewall 20. Alternate ones of the resonators 34 appear in the first and the second sets of resonators 34A and 34B. This is in accordance with the interdigital arrangement of the resonators. There is electromagnetic coupling among successive ones of the resonators, the coupling being accomplished via magnetic fields associated with each of the resonators 34.

The amount of the coupling is controlled by the spacings between successive ones of the resonators 34, and by use of partitions 38 which are located within the spaces between successive ones of the resonators 34. The partitions permit a more compact form. For example, for a narrow bandwidth of 0.5%, the resonators 34 are spaced apart from the partitions 38 such that the spacing between center lines of successive ones of the resonators 34 is less than approximately one-eighth wavelength of the electromagnetic radiation. This is significantly smaller than than a spacing of approximately one-quarter wavelength used in the absence of the partitions. By way of example, the filter 10 of FIG. 1 may be operated at a frequency of 2 gigahertz (GHz) wherein the wavelength is approximately 6 inches. The partitions 38 may have the form of a post 38A, or an iris plate 38B, or a partial wall 38C, or a rod 38D, by way of example. In practice, in the construction of such a filter, all of the partitions would be of the same form, such as the partition 38C having the shape of a wall. The showing of multiple forms of the partitions in each of the figures is for simplicity to facilitate explanation of the invention. In any one of these configurations, the partition 38 serves to reduce the amount of coupling between successive ones of the resonators 34.

Typically, the width of a broad wall 16 or 18 is approximately one-quarter wavelength. Thus, each of the resonators 34 has a length which is less than one-quarter of the wavelength and, preferably, is greater than one-eighth of the wavelength. This constitutes a foreshortening of the resonators 34 from a magnitude of one-quarter wavelength.

Figure 3:
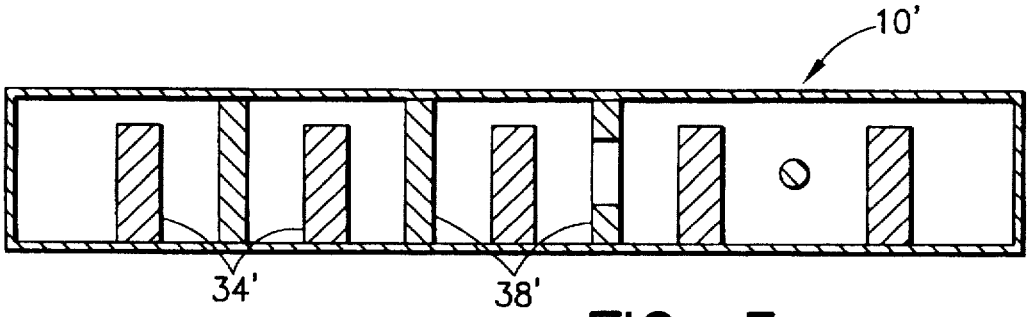
FIG. 3 PRIOR ART
FIG. 3 is a sectional view, corresponding to the sectional view of FIG. 1, of a combline filter of the prior art.
Figure 4:
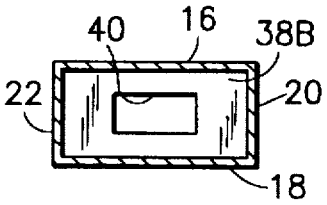
FIGS. 4 and 5 are sectional views of the microwave structure of FIG. 1 taken along the lines, respectively, 4—4 and 5—5.
Figure 5:
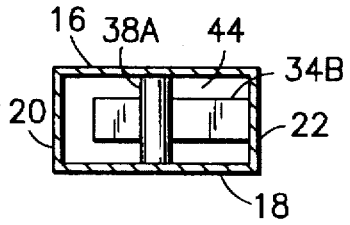

Comparison of the interdigital line of the invention may be made with the prior art combline configuration of resonators, disclosed in FIG. 3. In the combline configuration of a filter 10' in FIG. 3, all of the resonators 34' are grounded to one of the sidewalls, this being in contrast to the configuration of the invention wherein alternate ones of the resonators are grounded at one of the sidewalls, while the remainder of the resonators are grounded to the other of the sidewalls. Partitions 38' are located between the combline resonators 34' in FIG. 3. The configuration of the resonators of both FIGS. 1 and 3 have similar configurations wherein the resonators are parallel to the broad walls and spaced apart from these walls.

Figure 2:
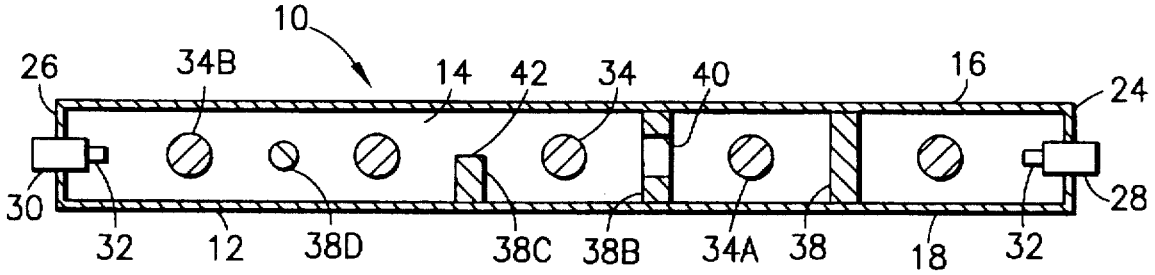
FIG. 2 is a longitudinal sectional view of the structure of FIG. 1 taken through broad walls of the microwave structure.

In the operation of the filter 10, it is recognized that each of the partitions 38 has a sufficient aperture herein, such as the aperture 40 of the iris plate 38B, to allow for a sufficient interaction between a pair of resonators 34A and 34B wherein the alternate grounding of the resonators 34A and 34B produce a reduction in the intensity of surface currents within the walls of the housing 12. This increases the Q of the filter 10 over that which can be obtained with the prior art configuration of FIG. 3. Other examples of the coupling apertures of FIGS. 1 and 2 are the apertures 42 and 44 respectively of the partitions 38C and 38A. In the case of the partial wall of the partition 38C, the the partial wall leaves the aperture 42 between the edge of the wall and the broad wall 16 for a coupling of electromagnetic energy. In the case of the partition 38A, the space between the post 38A and the sidewalls 20 and 22 (FIG. 5) constitutes the aperture 44 for the coupling of electromagnetic energy. In order to ensure sufficient interaction between the electromagnetic fields of two successive resonators 34A and 34B for the reduction of surface currents by the interdigital arrangement of the resonators 34, an aperture such as the aperture 42 should provide at least approximately a 10% opening as compared to the entire cross sectional region of the partial wall 38 plus the area of the aperture. It is noted that the same amount of coupling can be obtained with different sized apertures by providing for a corresponding adjustment in the spacing between two resonators 34A and 34B. An increase in spacing decreases the coupling so that a larger aperture in the partition 38 can be employed.

Figure 6:
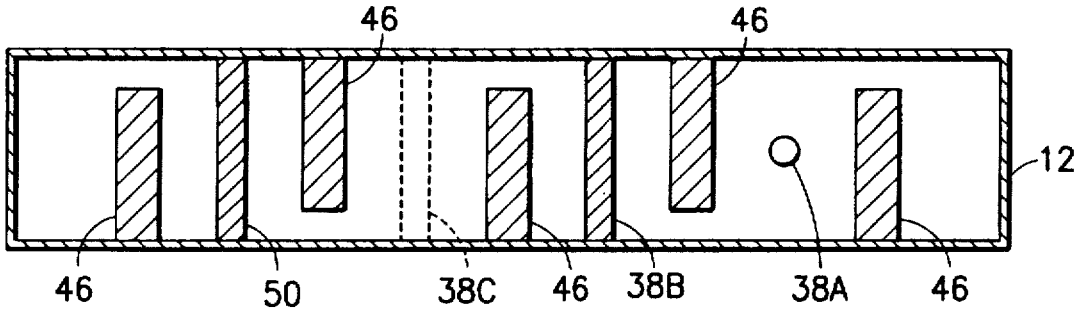
FIG. 6 is a longitudinal sectional view, similar to that of FIG. 1, FIG. 6 being directed to any one of three alternative embodiments of the invention.
Figure 7:
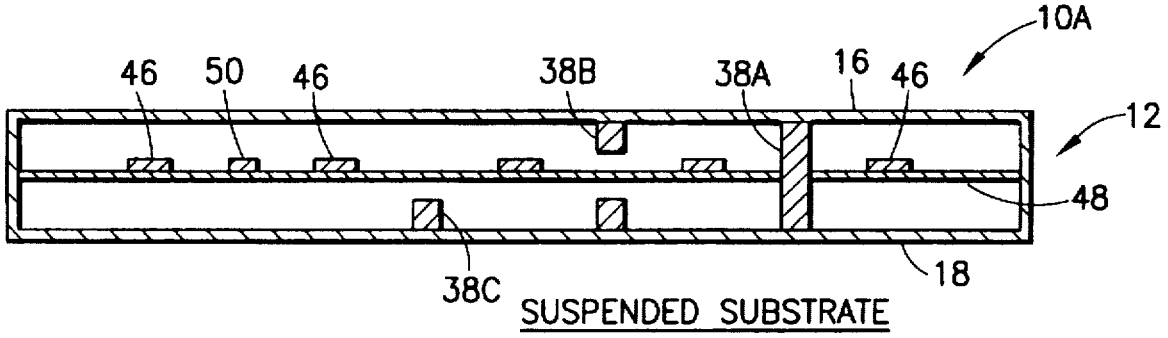
FIG. 7 is a longitudinal sectional view of the structure of FIG. 6 taken through broad walls of the microwave structure in accordance with a first of the alternative embodiments of the invention.

With reference to FIGS. 6 and 7, there is shown an alternative embodiment of the invention wherein the resonators 34 of FIG. 1 are constructed as metallic strips 46 disposed on a substrate 48, such as a printed circuit board having a dielectric constant greater than the air of the internal environment of the housing 12. In the filter 10A of FIG. 7, the substrate 48 is suspended between the broad walls 16 and 18 to locate the metallic strips 46 of the resonators on an axial plane along a longitudinal axis of the housing 12. The rod 38D of FIG. 2 is constructed in the filter 10A as a metallic strip 50 disposed on the substrate 48. With respect to the partitions 38 of FIGS. 1 and 2, the post 38A and the iris plate 38B and the partial wall 38C retain the same physical structure in the filter 10A of FIG. 7 as shown in FIG. 2 for the filter 10.

Figure 8:
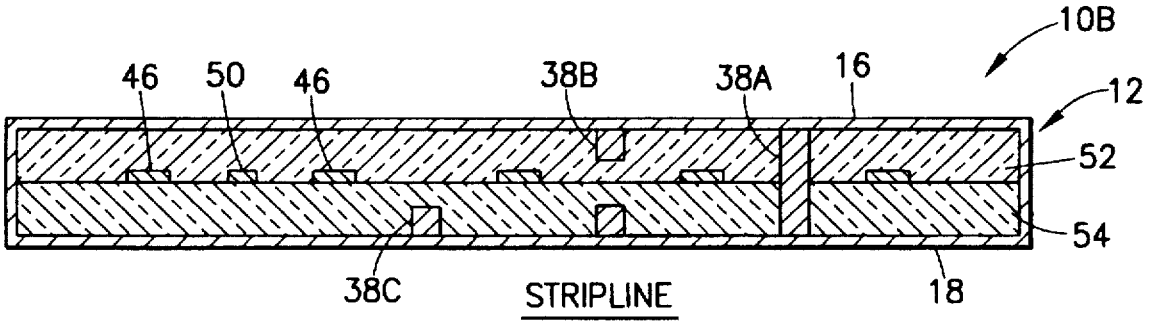
FIG. 8 is a longitudinal sectional view of the structure of FIG. 6 taken through broad walls of the microwave structure in accordance with a second of the alternative embodiments of the invention.
Figure 9:
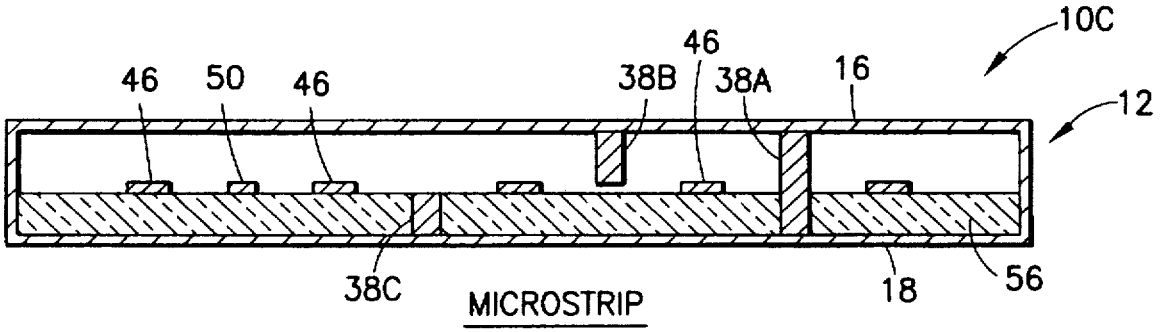
FIG. 9 is a longitudinal sectional view of the structure of FIG. 6 taken through broad walls of the microwave structure in accordance with a third of the alternative embodiments of the invention.

With respect to FIGS. 6 and 8, there is shown the construction of the filter 10B which is a further embodiment of the invention. In the filter 10B, the metallic strips 46 and 50 (previously shown in FIG. 7) are supported between two layers 52 and 54 of dielectric material. The post 38A, the iris plate 38B, and the partial wall 38C are constructed in the same fashion as disclosed with reference to FIGS. 7 and 2. the construction of the filter 10B may be referred to as a stripline construction in view of the positioning of the metallic strips 46 and 50 between the two dielectric layers 52 and 54. The dielectric material of the layers 52 and 54 may have a dielectric constant similar to that of the substrate 48 (FIG. 7) such a dielectric constant having, by way of example, a value of approximately 2. FIG. 9 shows a filter 10C which is constructed in accordance with yet another embodiment of the invention which includes the metallic strips 46 and 50 of FIGS. 7 and 8, but wherein the metallic strips 46 and 50 are supported by a dielecric layer 56 in the microstrip form of construction. Above the layer 56, the housing 12 is filled with air as is the case in the embodiments of FIGS. 2 and 7. The post 38A, the iris plate 38B, and the partial wall 38C have the same construction in FIG. 9 as has been shown in FIGS. 2, 7, and 8.

The foregoing construction of the invention provides for a more compact structure with higher Q, this being advantageous in microwave structures serving as cavity filters, multiplexers and duplexers.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A distributed TEM resonator bandpass microwave structure comprising:

a housing of electrically conductive material, said housing comprising a plurality of walls including first and second opposed walls extending in a longitudinal dimension of said housing;

a first set of resonators located within said housing and being arranged serially along the longitudinal dimension, resonators of said first-set extending from and being grounded to said first wall, and being spaced apart from and capacitively coupled to said second wall;

a second set of resonators located within said housing and being arranged serially along the longitudinal dimension, resonators of said second set being grounded to said second wall, and being capacitively coupled to said first wall, wherein the resonators of said first and said second sets are positioned relative to each other serially along the longitudinal dimension in an interdigital arrangement; and a set of partitions located within said housing and being positioned between successive ones of the resonators of said interdigital arrangement, each of said partitions being grounded to said housing and, in conjunction with a wall of said housing, defining an aperture for coupling electromagnetic radiation between successive ones of said resonators;

wherein, for each of said partitions, there is a ratio of area of the coupling aperture to the total area of coupling aperture and partition, the ratio being in excess of approximately 10% for reduction of intensity of surface currents within walls of said housing; and said first set of resonators and said second set of resonators are constructed as a microstrip.

2. A microwave structure according to claim 1 wherein the microwave structure is a filter.

3. A microwave structure according to claim 1 further comprising an input energy coupling port and an output energy coupling port disposed in said housing at opposite ends of said interdigital arrangement of said resonators.

4. A microwave structure according to claim 1 wherein each of said resonators and each of said partitions is electrically conductive.

5. A microwave structure according to claim 1 wherein at least one of said resonators has a rectangular shape.

6. A microwave structure according to claim 1 wherein at least one of said partitions has a rectangular shape leaving a coupling aperture extending between a pair of opposed walls of said housing.

7. A microwave structure according to claim 6 wherein said coupling aperture extends from said first wall to said second wall.

8. A microwave structure according to claim 1 wherein said first set of microstrip resonators and said second set of microstrip resonators are constructed on a suspended substrate.

9. A distributed TEM resonator bandpass microwave structure comprising:

a housing of electrically conductive material, said housing comprising a plurality of walls including first and second opposed walls extending in a longitudinal dimension of said housing;

a first set of resonators located within said housing and being arranged serially alone the longitudinal dimension, resonators of said first set extending from and being grounded to said first wall, and being spaced apart from and capacitively coupled to said second wall;

a second set of resonators located within said housing and being arranged serially along the longitudinal dimension, resonators of said second set being grounded to said second wall, and being capacitively coupled to said first wall, wherein the resonators of said first and said second sets are positioned relative to each other serially along the longitudinal dimension in an interdigital arrangement; and a set of partitions located within said housing and being positioned between successive ones of the resonators of said interdigital arrangement, each of said partitions being grounded to said housing and, in conjunction with a wall of said housing, defining an aperture for coupling electromagnetic radiation between successive ones of said resonators;

wherein, for each of said partitions, there is a ratio of area of the coupling aperture to the total area of coupling aperture and partition, the ratio being in excess of approximately 10% for reduction of intensity of surface currents within walls of said housing; and at least one of said resonators has a rod shape and a first one of said partitions has a rod shape, said first rod-shaped partition being perpendicular to said rod-shaped resonator, and wherein said first rod-shaped partition extends from a first section of wall of said housing across said housing to a second section of wall of said housing opposite said first section of wall of said housing.

10. A microwave structure according to claim 9 wherein at least one of said resonators has a rod shape and a second one of said partitions has a rod shape, said second rod-shaped partition being parallel to said rod-shaped resonator, and wherein said second rod-shaped partition extends from a first section of wall of said housing across said housing to a second section of wall of said housing opposite said first section of wall of said housing.

11. A distributed TEM resonator bandpass microwave structure comprising:

a housing of electrically conductive material, said housing comprising a plurality of walls including first and second opposed walls extending in a longitudinal dimension of said housing;

a first set of resonators located within said housing and being arranged serially alone the longitudinal dimension, resonators of said first set extending from and being grounded to said first wall, and being spaced apart from and capacitively coupled to said second wall;

a second set of resonators located within said housing and being arranged serially along the longitudinal dimension, resonators of said second set being grounded to said second wall, and being capacitively coupled to said first wall, wherein the resonators of said first and said second sets are positioned relative to each other serially along the longitudinal dimension in an interdigital arrangement; and a set of partitions located within said housing and being positioned between successive ones of the resonators of said interdigital arrangement, each of said partitions being grounded to said housing and, in conjunction with a wall of said housing, defining an aperture for coupling electromagnetic radiation between successive ones of said resonators;

wherein, for each of said partitions, there is a ratio of area of the coupling aperture to the total area of coupling aperture and partition, the ratio being in excess of approximately 10% for reduction of intensity of surface currents within walls of said housing;

said first set of resonators and said second set of resonators are constructed as a microstrip; and said housing encloses a uniform dielectric environment extending between neighboring ones of a resonator of said first set and a resonator of said second set.

* * * * *